United States Patent [19]

Ozaki et al.

[11] Patent Number: 4,808,223

[45] Date of Patent: Feb. 28, 1989

[54] SILVER/METAL OXIDE MATERIAL FOR ELECTRICAL CONTACTS AND METHOD OF PRODUCING THE SAME

[75] Inventors: Ryoji Ozaki, Kumagaya; Hisaji Shinohara, Saitama; Hironobu Yamamoto, Musashino; Takashi Nara, Abiko; Hajime Yoshida, Yokohama, all of Japan

[73] Assignees: Fuji Electric Co., Ltd., Kawasaki; Tokuriki Honten Co., Ltd., Tokyo, both of Japan

[21] Appl. No.: 70,577

[22] Filed: Jul. 7, 1987

[30] Foreign Application Priority Data

Jul. 8, 1986 [JP] Japan ..... 61-160183

[51] Int. Cl.[4] ..... C22C 29/12

[52] U.S. Cl. ..... 75/235; 75/232; 419/21; 252/512; 252/513; 252/514

[58] Field of Search ..... 75/232, 235; 419/21; 252/512, 513, 514

[56] References Cited

U.S. PATENT DOCUMENTS 3,501,287 3/1970 Lever ..... 419/21
4,609,525 9/1986 Schreiner et al. ..... 419/21

FOREIGN PATENT DOCUMENTS 34-10002 11/1959 Japan .
60-69595 6/1975 Japan .

*Primary Examiner*—Stephen J. Lechert, Jr.
*Attorney, Agent, or Firm*—Oblon, Fisher, Spivak, McClelland & Maier

[57] ABSTRACT

This invention relates to a silver/metal oxide material for electrical contacts containing no Cd which essentially consists of Ag and 5 to 30% by weight of at least one of oxides of Sb, Sn, Zn, In, Cu, Mn, Bi and Pb, and further, if necessary, 0.05 to 2% by weight of at least one of oxides of Mg, Al, Fe, Ni, Co, Si, Ga, Ge, Te, Ca and Li, the total amount of said metal oxides being 5 to 32% by weight, wherein fine particles of said metal oxides are substantially uniformly distributed in a matrix whose main component is Ag in a sintered state, and wherein there are no grain boundaries formed by agglomerations or agglomerated layers of said metal oxides. Further, the method of producing the same is provided including steps of: changing in steps the hydrogen ion concentration in an aqueous solution of Ag ions and at least one of metal ions of Sb, Sn, Zn, In, Cu, Mn, Bi and Pb, and further, if necessary, at least one of metal ions of Mg, Al, Fe, Ni, Co, Si, Ga, Ge, Te, Ca and Li so as to form precipitates of Ag-oxygen compound and oxides and/or hydroxides of said metals; drying and thereafter heat-treating said precipitates to form mixed powder of Ag and oxides of said metals and shaping and sintering said mixed powder; and further, if necessary, heat-treating the sintered material to stabilize.

14 Claims, 1 Drawing Sheet

(x350)

(x350)

SILVER/METAL OXIDE MATERIAL FOR ELECTRICAL CONTACTS AND METHOD OF PRODUCING THE SAME

BACKGROUND OF THE INVENTION

1. Field of the Invention

This invention relates to a silver/metal oxide material for producing electrical contacts which contains Ag as a main component and in which a metal oxide is distributed, and more particularly, to a material for producing electrical contacts which contains no Cd and to a method of producing this material.

2. Description of the Prior Art

Rationalization and automation in various industrial fields have been remarkably promoted in recent years, and related apparatuses tend to be increased in size and become complicated. In contrast, it would rather be necessary to reduce the size of a control system for such apparatuses and increase the frequency of its use and the capacity. Also the loads of its electrical contacts are now being increased.

A so-called Ag metal oxide material for producing electrical contacts consisting of Ag/and cadmium oxide distributed therein has superior contact characteristics in terms of welding resistance, errosion resistance and so forth and is specifically effective when used as a medium-load contact. On the other hand, materials containing no Cd have been developed on a turning point where the harmfulness and the problems of pollution resulting from refining of Cd were pointed out. It has been confirmed that materials made by distributing oxides such as those of Sb, Sn, Zn, In, Cu, Mn, Bi, Pb into Ag enable contact properties equivalent or superior to those realized by Ag/cadmium oxide materials and that they are therefore effective.

These silver/metal oxide material for producing electrical contacts are made on the basis of a sintering process or an internal-oxidation process, and they are mostly made by an internal-oxidation process at present.

In an internal-oxidation process, an alloy produced by melting from Ag and solute metals such as Cd, Sb, Sn and so forth is worked to have a desired shape, and this alloy is usually heated to a temperature higher than about 740° C. at an oxygen partial pressure higher than 3 atm, thereby selectively oxidizing only the solute metals. This process entails a certain limitation in the compositional conditions which at least assures plastic working and internal oxidation.

This internal-oxidation process causes a concentration gradient of a solute metal in the alloy in the direction of the thickness thereof facing the direction of the diffusion of oxygen since, in this internal-oxidation process, oxygen is forcibly supplied from the outside so that solute metals in a solid phase are oxidized for a long time with oxygen diffused in the Ag matrix. This is extremely disadvantageous in terms of contact characteristics and is basically inevitable because of the mechanism of oxidation.

It is well known that, particularly in the case of oxidation effected from both surfaces of the material, unevenness of concentration is gathered to a central portion so that a layer where the densities of oxides are low is formed therein (depleted zone) (refer to Japanese Patent Publication No. 16505/1985). The thickness of this layer varies depending on the kinds and the concentrations of solute metals, the oxygen partial pressure and the internal-oxidation temperature, and it reaches even 0.1 to 0.3 mm, the contact characteristics thereby being greatly damaged.

According to this process, oxygen is diffused from the outside into the contact piece through the entire thickness thereof and, therefore, the greater the thickness, the longer the time for oxidation. This process also has disadvantages in terms of production control such as difficulty in the determination of the time when the oxidation is completed and a resultant high fraction defective.

Since the internal-oxidation process is effected by forcibly supplying oxygen into the material from the outside at a high temperature under a high pressure, a certain degree of strain remains after the completion of this process, and at the same time some increase in volume corresponding to the quantity of oxygen entering into the material is caused, resulting in internal defects such as fine cracks.

One of inevitable disadvantages of the internal-oxidation process resides in the existence of grain boundaries formed by agglomeration of oxides. The grain boundaries have extremely low electric and thermal conductivities and act to reduce the emanation rate of heat generated as joule heat or arc heat so that the contacts tend to accumulate heat, thereby causing a temperature rise thereof and, hence, increase in the amount of errosion.

Moreover, this internal-oxidation process has a fatal disadvantage in that the quantities and the kinds of solute metals relative to Ag are limited since it is difficult for oxygen to enter into the material to continue the internal oxidation if the content of solute metals exceeds a certain level.

On the other hand, powder metallurgy, which is also called a sintering method, is a generic name of methods in which Ag powder and base metal oxide powder are sintered or Ag powder and base metal powder are internally oxidized after they are sintered. It includes:

① "Ag powder—oxide powder mixing sintering method" in which Ag powder and oxide powder or coprecipitation oxide powder formed from base metals are mechanically mixed and thereafter sintered;

② "Sintering and internal-oxidation method" in which Ag alloy powder which is made by atomization and which is not yet oxidized is sintered and thereafter undergoes internal oxidation;

② "Crushed piece internal oxidation sintering method" in which plates or wires formed after casting are crushed and small pieces thus formed undergo internal oxidation and are thereafter sintered;

④ "Internal oxidation and crushing sintering method" in which an Ag alloy formed after casting is worked into plates or wires and thereafter undergoes internal oxidation and Ag/metal oxide material thus obtained is mechanically crushed and sintered, and so forth. However, all of these methods other than Method ① utilize internal oxidation.

Method ① which is a typical type of powder metallurgy does not need any large-scale equipment for melting process and hhas an advantage in that it is possible to use various types of oxide powder without any limitation in terms of formation of an alloy and internal oxidation. However, it is basically impossible for this method to omit the process of mechanically and physically mixing Ag powder and metal oxide powder, and therefore, this method tends to cause segregation in relation to the composition and cannot realize a uniform sintering density since it is difficult for this method to uniformly mix the powder because of the difference between specific gravities, so long as the method is performed in the gravitational field. For this reason, this method is scarcely used at present.

Method ② inherits the defects of the internal-oxidation process itself. And further, method ③ causes similar problems since it is necessary for method ③ to effect internal oxidation at a low temperature as in the case of method ② in order to prevent from diffusion between the mutual small pieces. Accordingly, this method causes the formation of depleted zone in each small piece in which the content of oxides is very low, as in the case of the abovedescribed internal oxidation.

Method ④ uses a very complicated process in which an Ag alloy is formed to plates or wires by melting, casting, forging and plastic working and in which the alloy is pulverized after perfectly oxidized in the manner of internal oxidation, thereby considerably increasing the production cost. Moreover, there is a certain limitation of processing in mechanical pulverization, and this method cannot reduce the particle size below 0.1 mm, and therefore cannot provide fine powder. Also there is a possibility of extraneous substances being mixed with the powder at the time of pulverization and affecting the characteristics of the resultant material. And further, a depleted zone formed at the time of internal oxidation may be broken but they remain in the mixture as coarse grains and affect the internal structure after sintering and cause unevenness of this structure, resulting in abnormal errosion.

SUMMARY OF THE INVENTION

It is an object of the present invention to provide an Ag/metal oxide material for electrical contacts containing no Cd and improved in contact characteristics such as welding resistance, errosion resistance, and contact stability by freely selecting the contents and the kinds of metal oxides while eliminating various defects caused by the above-described conventional production methods, e.g., "uneven distribution of oxides" in the case of the sintering method, and "residual strain occurring at the time of internal oxidation", "crack-like internal defects due to increase in the volume at the time of entering of oxygen", "unevenness of oxide particles or crystal grains inside and in the vicinity of the surface" and "grain boundaries of low heat conductivity and high electric resistance" in the internal oxidation method; (that is, to provide a material free from internal strains and defects, uniformly formed of fine oxide particles inside and at the surface without any grain boundaries having low heat conductivity and high electric resistance).

BRIEF DESCRIPTION OF THE DRAWINGS

In the accompanying drawings.

DETAILED DESCRIPTION OF THE INVENTION

Figure 1:
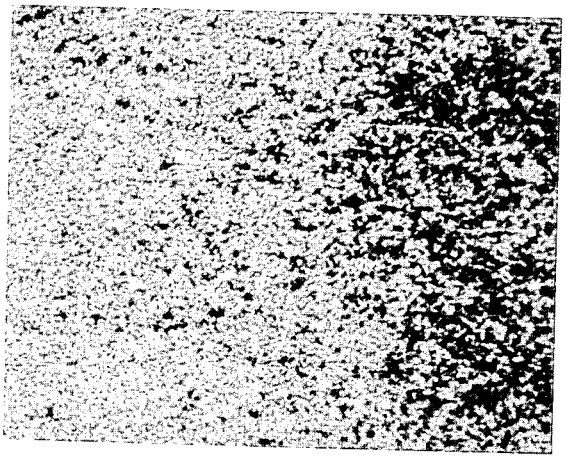
FIG. 1 is a microphotograph (×350) of the structure of a material in accordance with the present invention.
Figure 2:
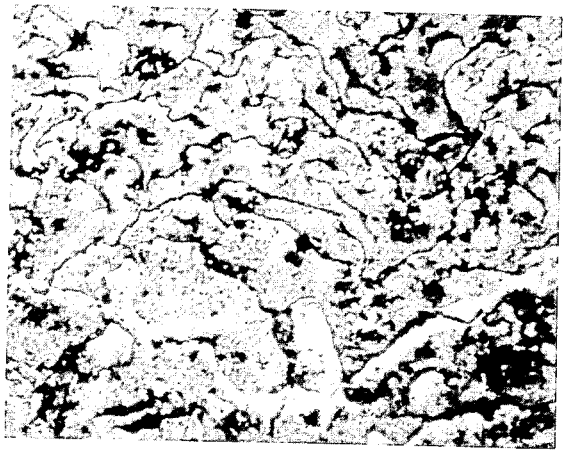
FIG. 2 is a microphotograph (×350) of the structure of a material in accordance with the conventional method.

To this end, the present invention provides an Ag/metal oxide material for producing electrical contacts containing no Cd which essential consists of Ag and 5 to 30% by weight of at least one of metal oxides of Sb, Sn, Zn, In, Cu, Mn, Bi and Pb, and further, if necessary, 0.05 to 2% of at least one of metal oxides of Mg, Al, Fe, Ni, Co, Si, Ga, Ge, Te, Ca and Li and impurities (the total amount of the above metal oxides being 5 to 32%) wherein the above metal oxides are substantially uniformly distributed and, specifically, fine particles of the above metal oxides having particle size smaller than about 5 μm are uniformly distributed in a matrix whose main component is Ag, and wherein there are no grain boundaries formed by agglomerations of these metal oxides greater than about 20 μm nor an agglomerated layer, greater than about 20 μm formed of continuous agglomerations of such metal oxides. The present invention also provides a method of producing an Ag/metal oxide material for electrical contacts having the above structure without any Cd by changing in steps the hydrogen ion concentration in the aqueous solution containing ions of Ag and at least one of Sb, Sn, Zn, In, Cu, Mn, Bi and Pb, and further, if necessary, at least one of Mg, Al, Fe, Ni, Co, Si, Ga, Ge, Te, Ca and Li so as to simultaneously or successively precipitate Ag-oxygen compounds and oxides and/or hydroxides of the above metals into a mixture, drying and thereafter heat-treating precipitates thus obtained in a suitable manner to form mixed powder of Ag and oxides of the above metals, and shaping and sintering this mixed powder.

The material for producing electrical contacts in accordance with the present invention has a structure which cannot be made by the above-described known techniques. This material may show various superior characteristics when used to produce electrical contacts, as described below. The material in accordance with the present invention contains 5 to 30% by weight of one or more of oxides of main additive metals selected from a group consisting of Sb, Sn, Zn, In, Cu, Mn, Bi and Pb and contains, if necessary, 0.05 to 2% by weight of one or more oxides of subordinate additive metals selected from a group consisting of Mg, Al, Fe, Ni, Co, Si, Ga, Ge, Te, Ca and Li, the total content being 5 to 32% by weight. This is because, if the content of oxides of the above main additive metals exceeds 30%, the sintering of the material becomes difficult and the electric resistance is increased, while, if the content is less than 5%, the contact characteristics or, specifically, the welding resistance are reduced. On the other hand, if the content of the above subordinate additive elements is smaller than 0.05%, it is not possible to expect any synergistic admixture effect on the characteristics enabled by the oxides of the main additive elements. If the content is larger than 2%, the effects (for example, contact characteristics and sintering performance) enabled by the main additive element oxides are obstructed.

Hitherto, it is a well-known technique to produce oxides by the coprecipitation process. Also, a method of producing an Ag/cadmium oxide material for electric contacts has been known in which caustic alkalis and alkali carbonates are added to a mixed aqueous solution of silver salt and cadmium salt so as to make salts such as $Ag_2O$, $Ag_2CO_3$, $Cd(OH)_2$, $CdCO_3$, and so forth, these salts are heated and decomposed into mixed powder of Ag and cadmium oxide, and this powder is formed by pressing, thereafter heated and sintered (refer to Japanese Patent Publication No. 4706/1958). However, no method has been proposed which makes extremely fine hydroxides and oxides coprecipitate from a solution in which Ag ions and base metal ions other than Cd ions coexist while changing in steps the hydrogen ion concentration in this solution, as in the case of the present invention.

When hydroxides and oxides of metals other than Ag are formed in the solution, hydroxides and oxides highly tends to agglomerate with each other, thereby causing secondary agglomeration and growth of secondary particles, necessarily resulting in uneven distribution. Such agglomeration and growth, however, can be restricted by the presence of a large quantity of fine particles of silver-oxygen compounds precipitated in the solution containing Ag ions in high concentration, as shown in the present invention, so that highly uniformly distributed composite particles of Ag/base metal oxides can be obtained while eluding the above-described unevenness consequent upon the agglomeration and the growth. In the present invention, mixed powder which is obtained by such a coprecipitating means and suitable heat treatment is shaped and sintered. Thus, the present invention gives a sintered material having a structure in which extremely fine metal oxide particles having a particle size of, for example, smaller than about 5 μm or usually about 2 μm are uniformly distributed in a matrix and which does not have any grain boundaries formed of oxide agglomerations or agglomerated layers such as those seen in the case of the conventional internal-oxidation process.

The present invention will be described below in detail.

A raw-material solution in accordance with the present invention is provided by dissolving desired quantities of Ag and at least one of Sb, Sn, Zn, In, Cu, Mn, Bi and Pb, and further, if necessary, at least one of Mg, Al, Fe, Ni, Co, Si, Ga, Ge, Te, Ca and Li with nitric acid, mixed acid consisting of nitric acid and sulfuric acid, mixed acid consisting of nitric acid and hydrofluoric acid, or the like. An alkali is added to this acid solution while stirring the same, or the raw-material solution is added to an alkali solution while stirring the alkali solution, thereby changing the hydrogen ion concentration and precipitating a mixture of Ag-oxygen compounds and hydroxides and/or oxides of the above metals. In this case, it is necessary to avoid the use of an acid such as hydrochloric acid which might react with Ag ions to form a salt which is water-insoluble, and it is also necessary to pay attention to the use of an acid which tends to cause precipitation by reacting with added metal ions. If such precipitation occurs, it is not possible to expect fine and uniform distribution of desired oxides and hydroxides. And also, the raw-material solution may otherwise be provided by selecting suitable metal salts and dissolving them in water or acid so as to prepare an aqueous solution containing desired metal ingredients.

According to the present invention, the raw-material solution thus prepared is mixed with sodium hydroxide, potassium hydroxide and, if necessary, an oxidizing agent, and the hydrogen ion concentration is changed by using an acid solution so as to form fine precipitates of Ag-oxygen compounds and hydroxides and/or oxides of the above metals. Specifically, since the metals used in the present invention are possible to dissolve in the form of complex hydroxide ions $[M_2O_{n+1}]^{n-}$ in a stfong alkaline region, it is possible to temporarily dissolve the metals by making first to be moderately alkaline and making then to be strongly alkaline and thereafter, making again to precipitate by returning the hydrogen ion concentration thereof to weak region, thereby being possible to obtain extremely fine precipitates. This process is represented by the following general reaction formula:

$$Ag^+ + 2M^n \xrightarrow{OH^-} Ag{-}O\downarrow + M_2O_n\downarrow$$

$$\xrightarrow{OH^-} AgO^- + [M_2O_{n+1}]^{n-}$$

$$\xrightarrow{H^+} Ag{-}O\downarrow + M_2O_n\downarrow$$

where M is a metal element. An alkali carbonate solution as a strongly basic compound which is used in the method as in the above-described case where Cd is used [Japanese Patent Publication No. 4706/1958], is not preferable in this process mentioned above since it causes precipitation of silver carbonate and, therefore, necessitates a degassing operation and since it is difficult for this method to sufficiently increase the sintering density. In the case where Cd is used, coprecipitation can be effected by changing the pH value of the solution to 12 in one step, while, in the case of the above-mentioned additive elements, the solution is temporarily made to be strongly alkaline and the pH value is thereafter returned to a weak alkaline region so that hydroxides and oxides of the above-mentioned metals are precipitated with nuclei formed of extremely fine Ag-oxygen compound particles. Therefore, changing in steps the hydrogen ion concentration in accordance with the method of the present invention is effected in such a manner that, in the process of obtaining fine precipitates of Ag-O and $M_2O_n$, the solution is first made to be moderately alkaline by adjusting the pH value to about 10, it is then made to be strongly alkaline by adjusting the pH value to about 13, and later it is made to be weakly alkaline by adjusting the pH value to about 8 to 9.

If Ag-oxygen compounds and other hydroxides are obtained in the process in which they are repeatedly dissolved and precipitated by the pH changes effected by adding an acid and an alkali, they show specifically uniform distribution. It is therefore more effective to process in this manner.

To realize uniform precipitation, it is also important to stir the solution well during reaction.

Then, precipitates thus formed are sufficiently washed so as to remove water-soluble salts other than the Ag-oxygen compounds and the oxides or the hydroxides of additive metals. They are then dehydrated and dried and thereafter undergo heat treatment for about 1 to 5 hours at a temperature higher than 300° C. in an inert gas or an oxidizing atmosphere so that the hydroxides become oxides and the Ag-oxygen compounds are decomposed into Ag, thereby a material for producing electrical contacts in which extremely fine particles of the oxides having an average particle size of about 0.1 to 5.0 μm are uniformly distributed in Ag is obtained. The precipitates must be sufficiently washed so as to remove salts which might exert a bad influence upon the characteristics of the material.

The heat treatment is specified in accordance with the decomposition temperature at which additive metal ingredients (solute metal ingredients) are oxidized, and the temperature of the heat treatment is preferably about 400° C. The temperature, the atmosphere and the pressure are also selected in accordance with the kinds of metals. However, if the temperature is excessively high, the agglomeration of powder is rapidly promoted, and the formation of oxide particles having a particle size smaller than about 5 μm aimed by the present invention is obstructed, thereby making it difficult to effect uniform distribution of Ag and various metal oxides.

Highly-distributed mixed powder including fine and uniform metal oxide and Ag particles are shaped, sintered and thereafter worked into an Ag/metal oxide material for producing electrical contacts having a desired shape. The material for electrical contacts obtained in this manner is free from the above-described defects and has ideal properties.

This material may have an increased properties in terms of contact performence by undergoing heat treatment (stabilizing treatment) at a temperature higher than 600° C. for a comparatively long time so as to increase toughness of the material after sintering.

The features of the present invention will be described below by way of examples thereof.

EXAMPLE 1

A solution prepared by dissolving 40 g of Sb by adding 200 ml of sulfuric acid with heating, a solution prepared by dissolving 60 g of Sn by adding mixed acid consisting of 600 ml of nitric acid, 30 ml of hydrofluoric acid and 240 ml of water with heating and a solution prepared by dissolving 20 g of Cu, 6 g of Ni by adding 200 ml of nitric acid (1+1) with heating are added to a solution prepared by dissolving 1870 g of Ag by adding 4 l of nitric acid (1+1) with heating. This solution is sufficiently stirred, thereby preparing a raw-material solution.

Separately from the raw-material solution, a strongly basic aqueous solution (A) prepared by dissolving 7 kg of sodium hydroxide in 20 l of water and 1.5 kg of potassium persulfate powder as an oxidizing agent are prepared.

A quantity of solution (A) is added to the raw-material solution. When the pH value thereof reaches 10, the total amount of potassium persulfate powder is added to this solution. After the silver-oxygen compounds and oxides or hydroxides of additive metals have been formed, entire part of the remaining quantity of solution (A) is added so as to set the pH value to larger than 13. Then, a small quantity of nitric acid is added to the solution so as to adjust pH to 8.5, thereby forming preciptates.

These precipitates are washed, dehydrated and dried. Then, they undergo heat treatment in the atmosphere at 400° C. for 5 hours. Powder thus obtained is shaped, thereafter heated in the atmosphere at 780° C. for 3 hours, sintered, finally extruded by an extruding press into material having a thickness of 4 mm and a width of 30 mm. And further, Ag is applied as a cladding to one surface of this material so that brazing can be applied. The material is thereafter punched into a circular plate having a thickness of 1.5 mm and a diameter of 8 mm, thereby making test-sample contact [1].

EXAMPLE 2

A solution prepared by dissolving 20 g of Sb by adding 100 ml of sulfuric acid with heating, a solution prepared by dissolving 50 g of Sn by adding mixed acid consisting of 500 ml of nitric acid, 25 ml of hydrofluoric acid and 200 ml of water with heating, a solution prepared by dissolving 20 g of Zn, 40 g of In, 20 g of Cu by adding 400 ml of nitric acid (1+1) with heating are added to a solution prepared by dissolving 1850 g of Ag by adding 4 l of nitric acid (1+1) with heating. This solution is sufficiently stirred, thereby preparing a raw-material solution. A test-sample contact [2] is formed by the same succeeding process as that in Example 1.

EXAMPLE 3

A solution prepared by dissolving 10 g of Sb by adding 50 ml of sulfuric acid with heating and a solution prepared by dissolving 20 g of Sn, 100 g of Zn, 16 g of Te, and 2 g of Co by adding mixed acid consisting of 400 ml of nitric acid, 20 ml of hydrofluoric acid and 160 ml of water with heating are added to a solution prepared by dissolving 1852 g of Ag by adding 4 l of nitric acid (1+1) with heating. Then, this solution is sufficiently stirred, thereby preparing a raw-material solution. A test-sample contact [3] is formed by the same succeeding process as that in Example 1.

EXAMPLES 4 TO 27

Test-sample pieces [4] to [27] were formed by the same process as that in Example 1.

Test-sample contact [3A] as a stabilized contact example is also prepared by applying stabilizing treatment (heat treatment at 700° C. for 6 hours) to the material having the same composition as that of test-sample contact [3].

For comparison, pieces [1'] to [27'] were formed by the conventional internal-oxidation process from the material having the same compositions as those of the above materials for producing electrical contacts.

The results of the test are shown together with the compositions in the following table.

| Producing Method | Sample Number | Composition | Amount of Arc Errosion (mg) after 1000 switching operations | ASTM Text Number of Welding Occurrence after $10 \times 10^4$ Switching operations |
|---|---|---|---|---|
| Method of the Present Invention | 1 | 93.7Ag—2Sb—3Sn—1Cu—0.3Ni | 43.0 | 2 |
| | 2 | 92.5Ag—1Sb—2.5Sn—1Zn—2In—1Cu | 42.8 | 4 |
| | 3 | 92.6Ag—0.5Sb—1Sn—5Zn—0.8Te—0.1Co | 46.7 | 5 |
| | 3A | 92.5Ag—1Sb—2.5Sn—1Zn—2In—1Cu(Stabilizing treatment) | 43.5 | 2 |
| | 4 | 94.7Ag—5In—0.3Ni | 54.3 | 10 |
| | 5 | 88.6Ag—3Sb—1Sn—0.3Zn—5In—2Cu—0.1Fe | 41.1 | 3 |
| | 6 | 93.3Ag—3.5Sb—0.5Sn—1Zn—1.5Cu—0.2Li | 44.2 | 4 |
| | 7 | 91.5Ag—2Sb—1Sn—5Cu—0.2Mn—0.3Ni | 45.9 | 5 |
| | 8 | 91.1Ag—1.5Sb—4Sn—3In—0.3Mn—0.1Si | 41.5 | 3 |
| | 9 | 92.8Ag—1.6Sb—3Sn—1.5Zn—0.5Bi—0.2Ge—0.4Te | 46.7 | 6 |

-continued

| Producing Method | Sample Number | Composition | Amount of Arc Errosion (mg) after 1000 switching operations | ASTM Text Number of Welding Occurrence after $10 \times 10^4$ Switching operations |
|---|---|---|---|---|
| | 10 | 86.0Ag—6Sb—1.5Sn—0.5Zn—3In—2Cu—0.5Pb—0.5Ga | 33.4 | 0 |
| | 11 | 83.0Ag—12Sb—3Zn—1In—0.5Mg—0.5Li | 34.8 | 0 |
| | 12 | 84.0Ag—2.5Sb—6Sn—1Zn—2.5In—1Mn—1Bi—0.5Al—1Si—0.5Co | 32.6 | 1 |
| | 13 | 84.0Ag—12Sb—0.5Zn—0.5In—0.5Cu—0.5Bi—1Pb—0.5Ca—0.5Fe | 37.6 | 0 |
| | 14 | 83.5Ag—1Sb—12Zn—3Mn—0.5Si | 38.2 | 2 |
| | 15 | 79.0Ag—0.5Sb—1Sn—10Zn—0.5In—4Cu—3Pb—0.5Al—0.5Ca—1Ga | 39.1 | 0 |
| | 16 | 83.0Ag—0.5Sn—2Zn—2In—3Cu—2Mn—5Bi—2Pb—0.5Ge | 40.2 | 0 |
| | 17 | 86.0Ag—2Sb—0.5Zn—1In—1Cu—8Bi—0.5Pb—0.5Al—0.5Fe | 42.6 | 0 |
| | 18 | 84.5Ag—1.5Sn—8Mn—2Bi—3Pb—0.5Mg—0.5Ga | 43.4 | 2 |
| | 19 | 85.0Ag—2Sb—2Sn—2Zn—2In—2Cu—1Mn—1Bi—1.5Mg—0.5Co | 33.5 | 0 |
| | 20 | 87.5Ag—3In—2Cu—2Mn—2Bi—2Pb—1Al—0.5Si | 36.7 | 0 |
| | 21 | 83.0Ag—2Sb—12In—0.5Mn—1.5Bi—1Te | 41.6 | 3 |
| | 22 | 87.0Ag—1Sb—1Sn—1Zn—1Pb—5In—1Bi—0.5Si—0.5Ga—1Ge—1Fe | 31.8 | 0 |
| | 23 | 87.0Ag—1Sb—1Sn—1In—1Cu—1Mn—5Pb—0.5Mg—0.5Al—1Te—1Li | 39.5 | 0 |
| | 24 | 82.5Ag—0.5Sb—0.5Sn—0.5Zn—15Cu—0.5Mg—0.5Ga | 43.1 | 1 |
| | 25 | 85.0Ag—2Mn—1Bi—10Pb—0.5Al—0.5Ca—1.0Ge | 37.4 | 1 |
| | 26 | 82.5Ag—5In—5Cu—5Mn—1Pb—1Al—0.5Fe | 36.0 | 0 |
| | 27 | 84.5Ag—2Sb—1In—8Cu—1Mn—1Bi—0.5Pb—1.5Ca—0.5Ni | 39.2 | 0 |
| Conventional Method (internal-oxidation method) | 1′ | 93.7Ag—2Sb—3Sn—1Cu—0.3Ni | 48.8 | 15 |
| | 2′ | 92.5Ag—1Sb—2.5Sn—1Zn—2In—1Cu | 48.2 | 11 |
| | 3′ | 92.6Ag—0.5Sb—1Sn—5Zn—0.8Te—0.1Co | 52.5 | 13 |
| | 4′ | 94.7Ag—5In—0.3Ni | 61.0 | 18 |
| | 5′ | 88.6Ag—3Sb—1Sn—0.3Zn—5In—2Cu—0.1Fe | 48.5 | 8 |
| | 6′ | 93.3Ag—3.5Sb—0.5Sn—1Zn—1.5Cu—0.2Li | 49.5 | 12 |
| | 7′ | 91.5Ag—2Sb—1Sn—5Cu—0.2Mn—0.3Ni | 51.7 | 14 |
| | 8′ | 91.1Ag—1.5Sb—4Sn—3In—0.3Mn—0.1Si | 47.8 | 9 |
| | 9′ | 92.8Ag—1.6Sb—3Sn—1.5Zn—0.5Bi—0.2Ge—0.4Te | 52.6 | 20 |
| | 10′ | 86.0Ag—6Sb—1.5Sn—0.5Zn—3In—2Cu—0.5Pb—0.5Ga | Internal oxidation impossible | Internal oxidation impossible |
| | 11′ | 83.0Ag—12Sb—3Zn—1In—0.5Mg—0.5Li | Internal oxidation impossible | Internal oxidation impossible |
| | 12′ | 84.0Ag—2.5Sb—6Sn—1Zn—2.5In—1Mn—1Bi—0.5Al—1Si—0.5Co | Internal oxidation impossible | Internal oxidation impossible |
| | 13′ | 84.0Ag—12Sb—0.5Zn—0.5In—0.5Cu—0.5Bi—1Pb—0.5Ca—0.5Fe | Internal oxidation impossible | Internal oxidation impossible |
| | 14′ | 83.5Ag—1Sb—12Zn—3Mn—0.5Si | Internal oxidation impossible | Internal oxidation impossible |
| | 15′ | 79.0Ag—0.5Sb—1Sn—10Zn—0.5In—4Cu—3Pb—0.5Al—0.5Ca—1Ga | Internal oxidation impossible | Internal oxidation impossible |
| | 16′ | 83.0Ag—0.5Sn—2Zn—2In—3Cu—2Mn—5Bi—2Pb—0.5Ge | Internal oxidation impossible | Internal oxidation impossible |
| | 17′ | 86.0Ag—2Sb—0.5Zn—1In—1Cu—8Bi—0.5Pb—0.5Al—0.5Fe | Internal oxidation impossible | Internal oxidation impossible |
| | 18′ | 84.5Ag—1.5Sn—8Mn—2Bi—3Pb—0.5Mg—0.5Ga | Internal oxidation impossible | Internal oxidation impossible |
| | 19′ | 85.0Ag—2Sb—2Sn—2Zn—2In—2Cu—1Mn—1Bi—1.5Mg—0.5Co | Internal oxidation impossible | Internal oxidation impossible |
| | 20′ | 87.5Ag—3In—2Cu—2Mn—2Bi—2Pb—1Al—0.5Si | Internal oxidation impossible | Internal oxidation impossible |
| | 21′ | 83.0Ag—2Sb—12In—0.5Mn—1.5Bi—1Te | Internal oxidation impossible | Internal oxidation impossible |
| | 22′ | 87.0Ag—1Sb—1Sn—1Zn—1Pb—5In—1Bi—5Si—1Ga—1Ge—1Fe | Internal oxidation impossible | Internal oxidation impossible |
| | 23′ | 87.0Ag—1Sb—1Sn—1In—1Cu—1Mn—5Pb—5Mg—5Al—1Te—1Li | Internal oxidation impossible | Internal oxidation impossible |
| | 24′ | 82.5Ag—0.5Sb—0.5Sn—0.5Zn—15Cu—0.5Mg—0.5Ga | Internal oxidation impossible | Internal oxidation impossible |
| | 25′ | 85.0Ag—2Mn—1Bi—10Pb—0.5Al—0.5Ca—1.0Ge | Internal oxidation impossible | Internal oxidation impossible |

-continued

| Producing Method | Sample Number | Composition | Amount of Arc Errosion (mg) after 1000 switching operations | ASTM Text Number of Welding Occurrence after $10 \times 10^4$ Switching operations |
|---|---|---|---|---|
| | 26' | 82.5Ag—5In—5Cu—5Mn—1Pb—1Al—0.5Fe | Internal oxidation impossible | Internal oxidation impossible |
| | 27' | 84.5Ag—2Sb—1In—8Cu—1Mn—1Bi—0.5Pb—1.5Ca—0.5Ni | Internal oxidation impossible | Internal oxidation impossible |

Comparison tests are performed by employing an arc errosion testing machine (AC 200V, 15 A) and an ASTM contact testing machine (AC 200V, 80 A).

The structure of the material [1] in accordance with the present invention is compared with that of the material [1'] having the same composition and provided by the conventional internal-oxidation process.

As is apparent from the above table, internal oxidation does not proceed in most materials (from [10'] to [27']) in accordance with conventional method, while all the material having the same combination and quantity of metals added to Ag in accordance with the present invention can be internally oxidized. Also, as is apparent from the annexed photographs of the structures, the material in accordance with the present invention is free from crystal grains and shows a uniform and fine structure while the material in accordance with the conventional internal-oxidation process has a structure with grain boundaries of agglomerated oxides.

In a comparison between the characteristics of materials having the same composition shown in the table, the material in accordance with the present invention shows a smaller extent of erosion due to arcs and has an remarkably improved welding resistance, as indicated as the results of the ASTM test.

In a comparison between the characteristics of non stabilized material [3] and stabilized material [3A], material [3A] with stabilized treatment shows further improved arc-errosion resistance and welding resistance.

What is claimed is:

1. A method of producing an Ag/metal oxide material for electrical contacts which essentially consists of Ag and 5 to 30% by weight of at least one of oxides of Sb, Sn, Zn, In, Cu, Mn, Bi, and Pb, wherein fine particles of said oxides are substantially uniformly distributed in a matrix whose main component is Ag in a sintered state, and wherein there are no grain boundaries formed by agglomerations greater than 20 μm or agglomerated layers greater than 20 μm of said metal oxides, which comprises the steps of: changing in steps the hydrogen ion concentration in an initial aqueous solution containing Ag ions and at least one of metal ions of Sb, Sn, Zn, In, Cu, Mn, Bi and Pb so as to form precipitates of Ag-oxygen compounds and oxides and/or hydroxides of said metals' drying and thereafter heat-treating said precipitates to form mixed powder of Ag and oxides of said metals; and shaping and sintering said mixed powder.

2. A method of producing an Ag/metal oxide material for electrical contacts which essentially consists of Ag and 5 to 30% by weight of at least one of oxides of Sb, Sn, Zn, In, Cu, Mn, Bi and Pb and 0.05 to 2% of at least of oxides of Mg, Al, Fe, Ni, Co, Si, Ga, Ge, Te, Ca and Li, the total amount of said metal oxides being 5 to 32% by weight, wherein fine particles of said metal oxides are substantially uniformly distributed in a matrix whose main component is Ag in a sintered state, and wherein there are no grain boundaries formed by agglomerations greater than 20 μm or agglomerated layers greater than 20 μm of said metal oxides which comprises the step of: changing in steps the hydrogen ion concentration in an initial aqueous solution containing Ag ions, at least one of metal ions of Sb, Sn, Zn, In, Cu, Mn, Bi and Pb, and at least one of metal ions of Mg, Al, Fe, Ni, Co, Si, Ga, Ge, Te, Ca and Li so as to form precipitates of Ag-oxygen compounds and oxides and/or hydroxides of said metals; drying and thereafter heat-treating said precipitates to form mixed powder of Ag and oxides of said metals; and shaping and sintering said mixed powder.

3. A method of producing an Ag/metal oxide material for electrical contacts according to claim 1, wherein the initial solution containing Ag ions and at least one of metal ions of Sb, Sn, Zn, In, Cu, Mn, Bi and Pb, is first made to be moderately alkaline and is then made to be strongly alkaline and is thereafter made to be weakly alkaline so as to simultaneously or successively precipitate fine particles of Ag-oxygen compounds and oxides and/or hydroxides of said metals, and further, if necessary, repeating said steps.

4. A method of producing an Ag/metal oxide material for electrical contacts according to claim 2, wherein the initial solution containing Ag ions and at least one of metal ions of Sb, Sn, Zn, In, Cu, Mn, Bi and Pb, and at least one of metal ions of Mg, Al, Fe, Ni, Co, Si, Ga, Ge, Te, Ca and Li is first made to be moderately alkaline and is then made to be strongly alkaline and is thereafter made to be weakly alkaline so as to simultaneously or successively precipitate fine particles of Ag-oxygen compounds and oxides and/or hydroxides of said metals, and further, if necessary, repeating said steps.

5. A method of producing an Ag/metal oxide material for electrical contacts according to claim 1, wherein after changing in steps the hydrogen ion concentration in the initial aqueous solution containing of Ag ions and at least one of metal ions of Sb, Sn, Zn, In, Cu, Mn, Bi and Pb, so as to form precipitates of Ag-oxygen compounds and oxides and/or hydroxides of said metals, and wherein said precipitates are dried and thereafter undergo heat treatment in an inert gas or in an oxidizing atmosphere at a temperature higher than 300° C. for 1 to 5 hours so as to decompose said Ag-oxygen compounds into Ag and said hydroxides into oxides.

6. A method of producing an Ag/metal oxide material for electrical contacts according to claim 2 wherein after changing in steps the hydrogen ion concentration in an initial aqueous solution containing of Ag ions and at least one of metal ions of Sb, Sn, Zn, In, Cu, Mn, Bi and Pb, and at least one of metal ions of Mg, Al, Fe, Ni, Co, Si, Ga, Ge, Te, Ca and Li so as to form precipitates of Ag-oxygen compounds and oxides and/or hydroxides of said metals, and wherein said precipitates are dried and thereafter undergo heat treatment in an inert gas or in an oxidizing atmosphere at a temperature higher than 300° C. for 1 to 5 hours so as to decompose said Ag-oxygen compounds into Ag and said hydroxides into oxides.

7. A method of producing an Ag/metal oxide material for electrical contacts which essentially consists of Ag and 5 to 30% by weight of at lest one of oxides of Sb, Sn, Zn, In, Cu, Mn, Bi and Pb and the total amount of said metal oxides being 5 to 32% by weight, wherein fine particles of said metal oxides are substantially uniformly distributed in a matrix whose main component is Ag in a sintered state, and wherein there are no grain boundaries formed by agglomerations greater than 20 μm or agglomerated layers greater than 20 μm of said metal oxides, which comprises the steps of: changing in steps the hydrogen ion concentration in an initial aqueous solution containing of Ag ions and at least one of metal ions of Sb, Sn, Zn, In, Cu, Mn, Bi and Pb, so as to form precipitates of Ag-oxygen compounds and oxides and/or hydroxides of said metals; drying and thereafter heat-treating said precipitates to form mixed powder of Ag and oxides of said metals; and shaping and sintering said mixed powder; and further heat-treating said sintered material at a temperature higher than 600° C. for a long time to stabilize.

8. A method of producing an Ag/metal oxide material for electrical contacts which essentially consists of Ag and 5 to 30% by weight of at least one of oxides of Sb, Sn, Zn, In, Cu, Mn, Bi and Pb and 0.05 to 2% of at least one of oxides of Mg, Al, Fe, Ni, Co, Si, Ga, Ge, Te, Ca and Li, the total amount of said metal oxides being 5 to 32% by weight, wherein fine particles of said metal oxides are substantially uniformly distributed in a matrix whose main component is Ag in a sintered state, and wherein there are no grain boundaries formed by agglomerations or greater than 20 μm agglomerated layers greater than 20 μm of said metal oxides, which comprises the steps of: changing in steps the hydrogen ion concentration in an initial aqueous solution containing of Ag ions and at least one of metal ions of Sb, Sn, Zn, In, Cu, Mn, Bi and Pb, and at least one of metal ions of Mg, Al, Fe, Ni, Co, Si, Ga, Ge, Te, Ca and Li so as to form precipitates of Ag-oxygen compounds and oxides and/or hydroxides of said metals; drying and thereafter heat-treating said precipitates to form mixed powder of Ag and oxides of said metals; and shaping and sintering said mixed powder; and further heat-treating said sintered material at a temperature higher than 600° C. for a long time to stabilize.

9. A method according to claim 3, wherein the initial aqueous solution is first made moderately alkaline with NaOH or KOH by adjusting the pH to about 10 to cause precipitation of silver-oxygen compounds and metal hydroxide and/or oxygen compounds, then made strongly alkaline to dissolve the metal hydroxide and/or oxygen precipitates and then made weakly alkaline to obtain a precipitate of fine particles of the Ag-oxygen compounds and oxides and/or hydroxides of the metals, drying and thereafter heat-treating said precipitates for 1 to 5 hours at a temperature above 300° C. in an inert gas or in an oxidizing atmosphere to form mixed powder of Ag and oxides of said metals; and shaping and sintering said mixed powder.

10. A method according to claim 9 wherein, an first made moderately alkaline.

11. A method according to claim 4 wherein, the initial aqueous solution is first made moderately alkaline with NaOH or KOH by adjusting the pH to about 10 to cause precipitation of silver-oxygen compounds and metal hydroxide and/or oxygen compounds, then made strongly alkaline to dissolve the metal hydroxide and/or oxygen precipitates and then made weakly alkaline to obtain a precipitate of fine particles of the Ag-oxygen compound and the oxides and/or hydroxides of the metals, drying and thereafter heat-treating said precipitates for 1 to 5 hours at a temperature above 300° C. in an inert gas or in an oxidizing atmosphere to form mixed powder of Ag and oxides of said metals; and shaping and sintering said mixed powder.

12. A method according to claim 9 wherein an oxidizing agent is added to the solution when it is first made moderately alkaline.

13. The product of the method of claim 9.

14. The product of the method of claim 11.

* * * * *